US009743783B1

(12) United States Patent
Bersamin

(10) Patent No.: US 9,743,783 B1
(45) Date of Patent: Aug. 29, 2017

(54) AUTOMATIC ASSEMBLY DISPLAY HUTCH

(71) Applicant: Sonoco Development, Inc., Hartsville, SC (US)

(72) Inventor: Glen Bersamin, New Lenox, IL (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 15/443,777

(22) Filed: Feb. 27, 2017

(51) Int. Cl.
*A47F 5/10* (2006.01)
*A47F 5/00* (2006.01)

(52) U.S. Cl.
CPC ..... *A47F 5/10* (2013.01); *A47F 5/0018* (2013.01)

(58) Field of Classification Search
CPC ..... A47F 5/116; A47F 5/10; A47F 5/0018
USPC ..... 211/135
See application file for complete search history.

(56) References Cited

U.S. PATENT DOCUMENTS 1,602,410 A * 10/1926 Hamblin ..... A47F 5/108 108/179
2,150,743 A * 3/1939 Mancuso ..... G09F 5/00 211/135
2,340,148 A 1/1944 Silberstein
3,863,575 A * 2/1975 Kuns ..... A47B 43/02 108/179
4,151,803 A 5/1979 Ferrera et al.
4,630,740 A * 12/1986 Belokin, Jr. ..... A47B 87/0253 211/194
5,273,169 A * 12/1993 Maglione ..... A47F 5/116 108/162
5,366,100 A 11/1994 Maglione
5,826,732 A 10/1998 Ragsdale
6,752,280 B2 * 6/2004 Dye ..... A47F 5/116 108/162
7,007,615 B2 3/2006 Grueneberg
7,252,200 B1 8/2007 Hester
7,374,047 B2 5/2008 Bryson et al.
7,677,433 B2 * 3/2010 Little ..... B65D 5/526 206/744
7,703,864 B2 4/2010 Moser
7,905,365 B2 3/2011 Virvo
8,485,370 B2 7/2013 Dewhurst
9,211,021 B2 * 12/2015 Smith ..... A47F 5/116
9,474,389 B2 * 10/2016 Pfeifer ..... A47F 5/11
2013/0213915 A1 8/2013 Pfeifer et al.
2017/0079449 A1 * 3/2017 Smith ..... A47F 5/116

* cited by examiner

*Primary Examiner* — Ko Hung Chan
(74) *Attorney, Agent, or Firm* — Miller, Matthias & Hull LLP

(57) ABSTRACT

A collapsible, easy-to-assemble corrugated hutch for shipping and displaying products is provided. The hutch is made from three blanks. The hutch may be shipped flat, then "automatically" assembled by squaring up the hutch body and pushing downward and rearward on a rear support.

12 Claims, 13 Drawing Sheets

AUTOMATIC ASSEMBLY DISPLAY HUTCH

BACKGROUND OF THE INVENTION

Field of the Invention

This invention patent relates to a display hutch. More particularly, this invention relates to a display hutch that may be shipped flat, then "automatically" assembled by squaring up the hutch body and pushing downward and rearward on a rear support.

Description of the Related Art

Display hutches can be used to display items in a retail setting. Typically display hutches are made of multiple components and sometimes even require fasteners. Display hutches can also require complex assembly steps, and can be large even when knocked down. The present disclosure is designed to solve these problems.

BRIEF SUMMARY OF THE INVENTION

The present invention is a collapsible, easy-to-assemble corrugated hutch for shipping and displaying products is provided.

In one aspect the hutch comprises a rear wall, two side walls, front panels, shelves and a rear support used to assemble the hutch. The rear wall extends vertically from a base to a top edge and horizontally from one rear vertical edge to another rear vertical edge. Each side wall extends from a rear vertical edge forward to a front vertical edge. Each front panel extends laterally from and is hingedly attached to each side wall along the front vertical edges. The rear wall, the side walls and the front panels define a hutch body having an interior. The rear support is substantially disposed within the interior. Each shelf comprises a front shelf panel and a rear shelf panel adhered to the front shelf panel. Each front shelf panel is hingedly attached to a front panel along a shelf front fold line. Each shelf extends laterally between one side wall and the other side wall but is not directly connected to either sidewall. Each rear shelf panel is foldably connected to a rear attachment panel along a rear fold line. Each rear attachment panel is attached to the rear support. Moving the rear support causes the shelves to move in unison between a first position in which each shelf is in a vertical orientation and a second position in which each shelf is in a horizontal orientation suitable for bearing a load. The rear wall, the side walls, the front panels and the front shelf panels are formed from a first blank. The rear shelf panels and the rear attachment panels are formed from a second blank. The rear support is formed from a third blank.

In another aspect a method of constructing a hutch is provided comprising the steps of: Providing a first blank, a second blank and a third blank. The first blank comprises a rear wall, first and second side walls, front panels, front shelf panels and a glue panel, the rear wall extending from a bottom edge to a top edge and horizontally from a rear vertical edge to an opposite rear vertical edge, the rear panel being foldably connected to the first side wall along one rear vertical edge, the first side wall being foldably connected to the front panels along a front vertical edge, the second side wall being foldably connected to the front panels along another front vertical edge and to the glue panel along a glue panel fold line, each front shelf panel being foldably connected to a front panel along a shelf front edge, each front shelf panel having a free rear edge. The second blank comprises rear shelf panels, rear attachment panels, middle panels and two middle vertical panels, the middle panels extending laterally between and attached to the middle vertical panels, each rear shelf panel being hingedly attached to a middle panel along a middle fold line extending laterally between the middle vertical panels and to a rear attachment panel along a rear fold line. The third blank extends from a bottom edge to a top edge and from one side edge to an opposite side edge. Adhering the front shelf panels to the rear shelf panels. Adhering the attachment panels to the third blank. Folding the second side wall inward along fold line. Finally, folding the rear wall inwardly along a fold line and adhering the rear wall to the glue panel. Each rear free edge may define a first locating notch. Each rear attachment panel may have a free top edge that defines a second locating notch. Each rear shelf panel may define a locating hole. The third blank top edge may define a third locating notch and the third blank may define second locating holes spaced apart in the vertical dimension. During the first adhering step the first blank and the second blank may be aligned so that the locating holes align with the first locating notches. During the second adhering step the rear attachment panels and the third blank may be aligned so that the third locating notch and the second locating holes in the third blank align with the second locating notches.

In another aspect a method of assembling a hutch is provided comprising the steps of: Squaring up the hutch so that the side walls are parallel and the front panels are parallel with the rear wall. Positioning the hutch in an upright position. And pushing down on the rear support until each shelf is in a horizontal orientation.

DETAILED DESCRIPTION OF THE INVENTION

Figure 1:
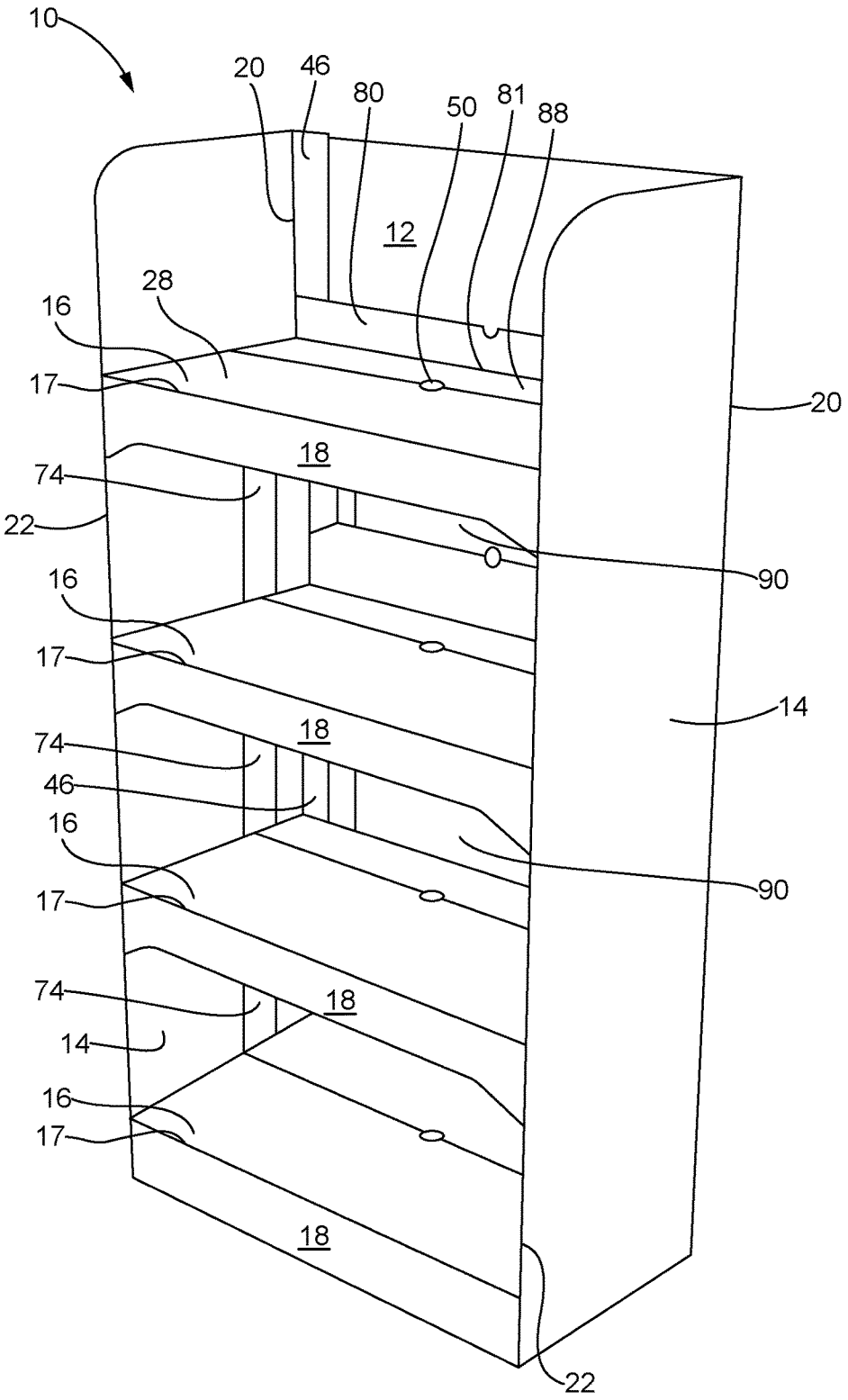
FIG. 1 is a front perspective view of a fully assembled hutch according to the disclosure.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments. Aspects of the different embodiments can be combined with or substituted for one another.

As will be appreciated, terms such as "above" and "below", "horizontally" and "vertically", "top" and "bottom," "front" and "back," (etc.), used as nouns, adjectives or adverbs refer in this description to the orientation of the structure of the hutch as it is illustrated in the various views. For example, "horizontally" refers to the dimension running from one side wall to the other side wall in FIG. 1. Such terms are not intended to limit the invention to a particular orientation.

The disclosure relates to a display hutch that may be shipped flat, then "automatically" assembled by squaring up a body blank and pushing downward and rearward on a rear support.

The Display Hutch

Turning to the drawings, FIG. 1 is a front perspective view of a display hutch 10 according to the disclosure. The hutch 10 is made from three separate blanks, a first blank 40, a second blank 70 and a third blank 90 adhered together. The hutch 10 comprises a rear wall 12, two side walls 14, shelves 16 and front panels 18. The hutch 10 may have two rear corners (a.k.a. rear vertical edges) 20 and two front corners (a.k.a. front vertical edges) 22.

The rear wall 12 may extend vertically the full height of the hutch 10 from a bottom or base 42 to a top or top edge 44 and horizontally from one side wall 14 to the opposite side wall 14.

Each side wall 14 extends from a rear vertical edge 20 forward to a front vertical edge 22. Each side wall is hingedly attached to the rear wall 12 along a rear vertical edge fold line 20, the rear vertical edge 20 functioning as a fold line 20.

Each shelf is formed from a front shelf panel 28 which is part of the first blank 40 and a rear shelf panel 88 which is part of the second blank 70. Each shelf 16 extends horizontally (laterally) between one side wall 14 and the opposing side wall 14 but is not directly connected to either side wall 14. Instead, each shelf 16 has free side edges 15 as perhaps best shown in FIG. 2. Each shelf 16 is foldably connected to a corresponding front panel 18 along a shelf front fold line 17. Each shelf 16 is foldably connected to a rear attachment panel 80 along a shelf rear fold line 81. The rear attachment panel 80 extends upwardly from the shelf rear fold line 81 and is attached to the third blank (a.k.a. rear support) 90. Thus, each shelf 16 is supported in front by a front panel 18 and in back by the rear support 90.

The front panels 18 are relatively short in height so as not to obscure the products that are on display on the shelf 16 below. Each front panel 18 extends downward from and is foldably attached to a shelf 16 along a shelf front fold line 17. Each front panel 18 extends horizontally from and is foldably attached to each side wall 14 along the front vertical edges 22.

Moving the rear support 90 up and down (in the direction of arrow D in FIG. 12) causes the shelves 16 to move in unison between a first position in which the shelves 16 are in a vertical orientation and a second position in which the shelves 16 are in a horizontal orientation.

The First Blank (Body Blank)

Figure 2:
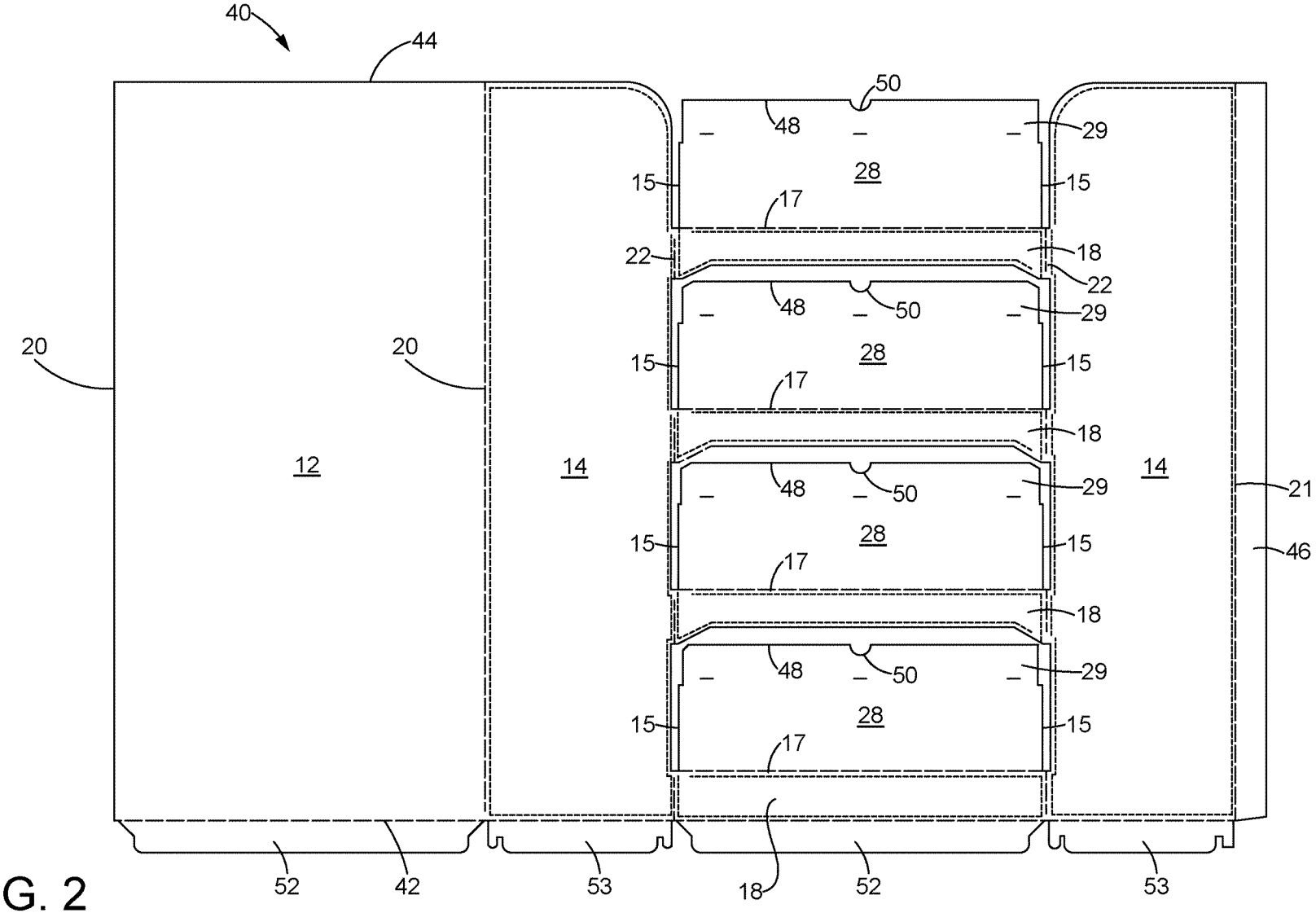
FIG. 2 is a top plan view of a first blank used to make the hutch of FIG. 1.

FIG. 2 is a top plan view of the first blank (a.k.a. body blank) 40 used to make the hutch 10 of FIG. 1. The first blank 40 is used to make the "body" of the hutch 10, that is, the rear wall 12, the side walls 14 and the front panels 18, as well as the front shelf panels 28.

The rear wall 12 may be substantially rectangular and may extend vertically from a bottom edge 42 to a top edge 44 and horizontally from one rear vertical edge 20 to an opposing rear vertical edge 20. The rear panel 12 is foldably connected to a side wall 14 along one rear vertical edge 20. The rear vertical edge 20 may be a fold line, score line or any suitable linear demarcation between panels.

One side wall 14, in this case, the right side wall 14, is foldably connected to the rear wall 12 along a rear vertical edge 20 and to the front panels 18 along a front vertical edge 22. The other (left) side wall 14 is foldably connected to the front panels 18 along the other front vertical edge 22. The left side wall 14 also is foldably connected to a glue panel 46 along a glue panel fold line 21. Alternatively, the glue panel may be connected to the rear wall 12.

Each front panel 18 is foldably connected at one end to a side wall 14 and at the opposite end to the other side wall 14.

Each front shelf panel 28 is foldably connected to a front panel 18 along a shelf front edge 17. Each front shelf panel 28 has a free rear edge 48. Each free rear edge 48 may define a first locating notch 50 which may be used to construct the hutch 10 as explained below. Each front shelf panel 28 may comprise a glue area 29 located along the rear portion of the front shelf panel 28 near the free rear edge 48.

Front and rear bottom panels 52 and side wall bottom panels 53 may be foldably attached to each of the major panels and the lowest front panel 18 along a bottom fold line 42. The side wall bottom panels 53 may be configured to interlock with the other bottom panels 52.

The Second Blank (a.k.a. Center Support)

Figure 3:
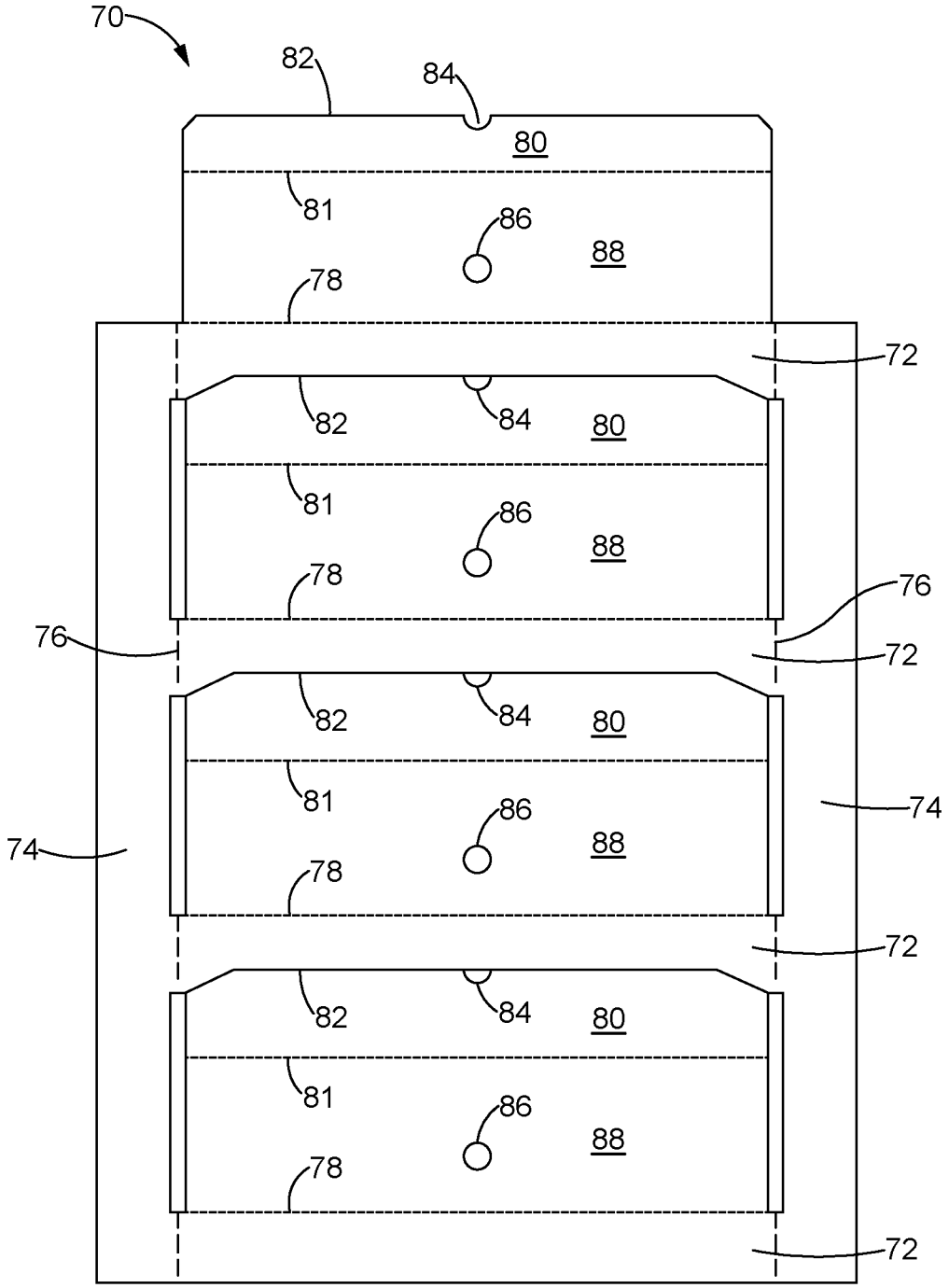
FIG. 3 is a top plan view of a second blank used to make the hutch of FIG. 1.

FIG. 3 is a top plan view of the second blank 70 used to make the hutch 10 of FIG. 1. The second blank 70 comprises the rear shelf panels 88, the rear attachment panels 80, middle panels 72 and two parallel middle vertical panels 74. Each middle panel 72 extends laterally between and is hingedly attached to a pair of middle vertical panels 74 at either end along a fold line 76. Each rear shelf panel 88 is hingedly attached to a middle panel 72 along a middle fold line 78 extending laterally between the middle vertical panels 74. Each rear shelf panel 88 is hingedly attached to a rear attachment panel 80 along a rear fold line 81 parallel with the middle fold line 78.

Each rear attachment panel 80 has a free top edge 82 that may define a second locating notch 84. Each rear shelf panel 88 may define a locating hole 86 located equidistant the fold lines 76.

The Third Blank (a.k.a. Rear Support)

Figure 4:
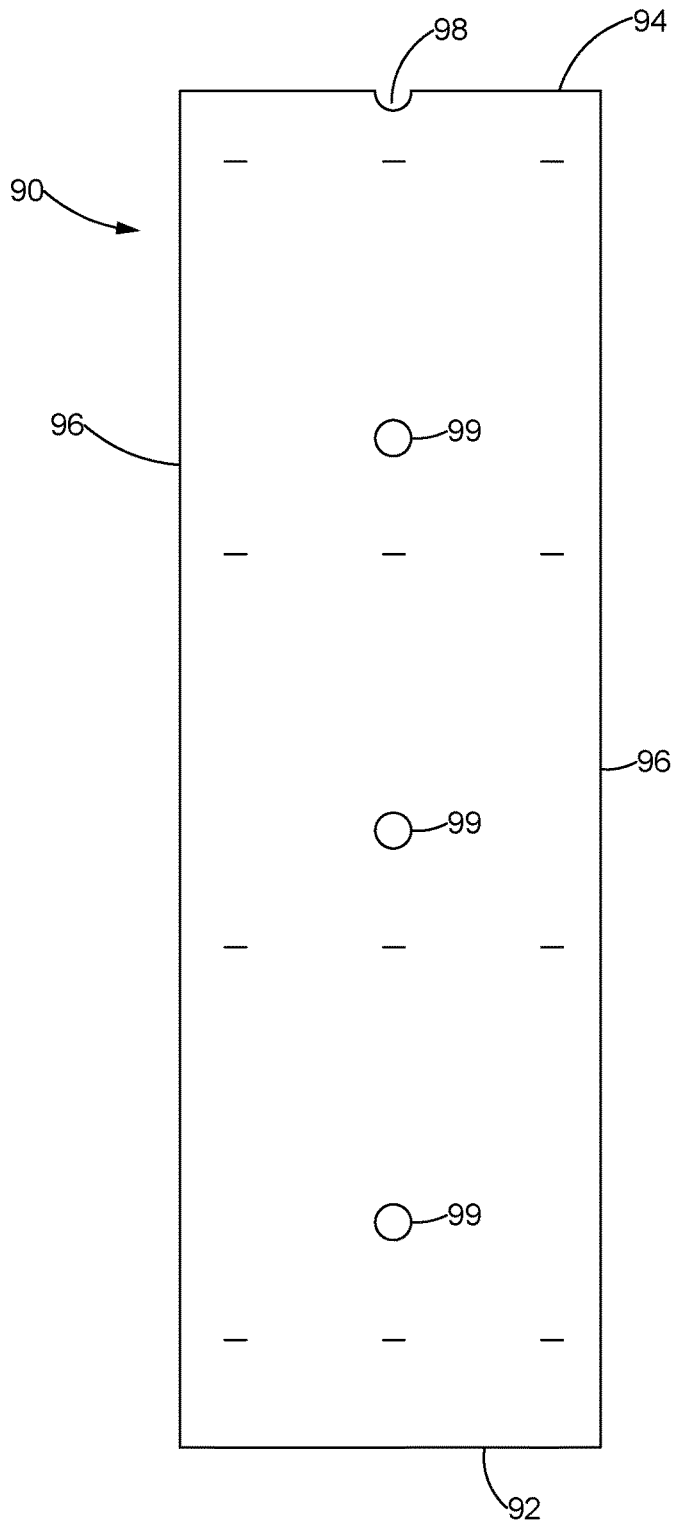
FIG. 4 is a top plan view of a third blank used to make the hutch of FIG. 1.

FIG. 4 is a top plan view of the third blank 90 used to make the hutch 10 of FIG. 1. The third blank 90 is used to support the rear of the shelves 16. The third blank 90 may be substantially rectangular and may extend from a bottom edge 92 to a top edge 94 and from one side edge 96 to an opposite side edge 96. The top edge 94 may define a third locating notch 98. The third blank 90 may define second locating holes 99 located equidistant the side edges 96 and spaced apart in the vertical dimension. The width of the third blank 90 preferably is less than the width of the second blank 70 (measured from one fold line 76 to the other fold line 76.

Method of Construction

Figure 13:
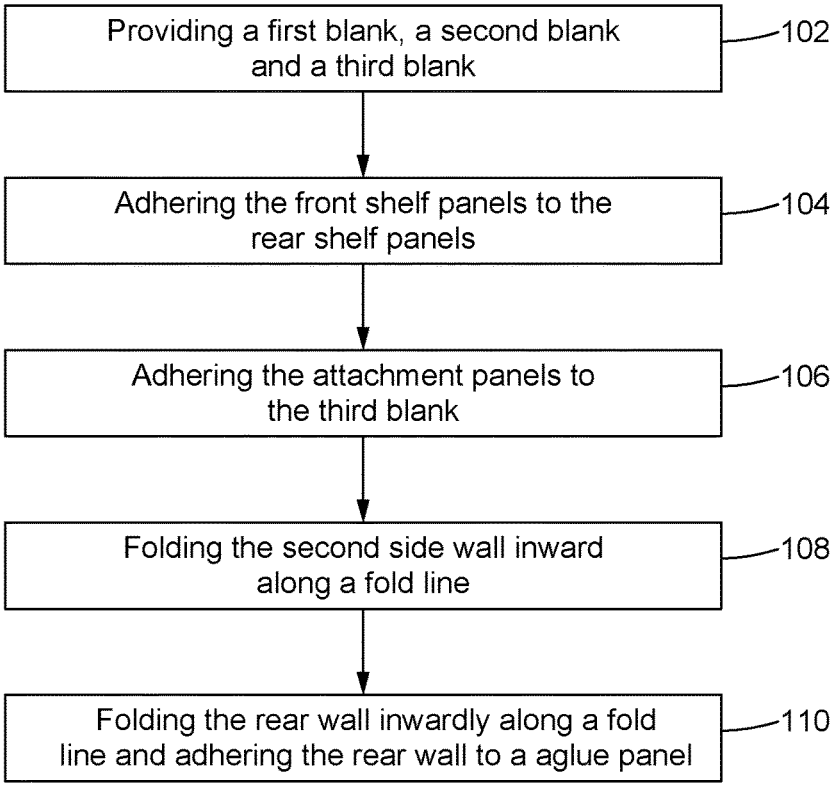
FIG. 13 is a flowchart illustrating a method of constructing the hutch of FIG. 1.

FIG. 13 is a flowchart illustrating a method of constructing the hutch of FIG. 1. A method of assembly of the hutch 10 will now be described with reference to FIGS. 5-8.

Step 102: Providing three blanks 40, 70, 90 as described above.

Figure 5:
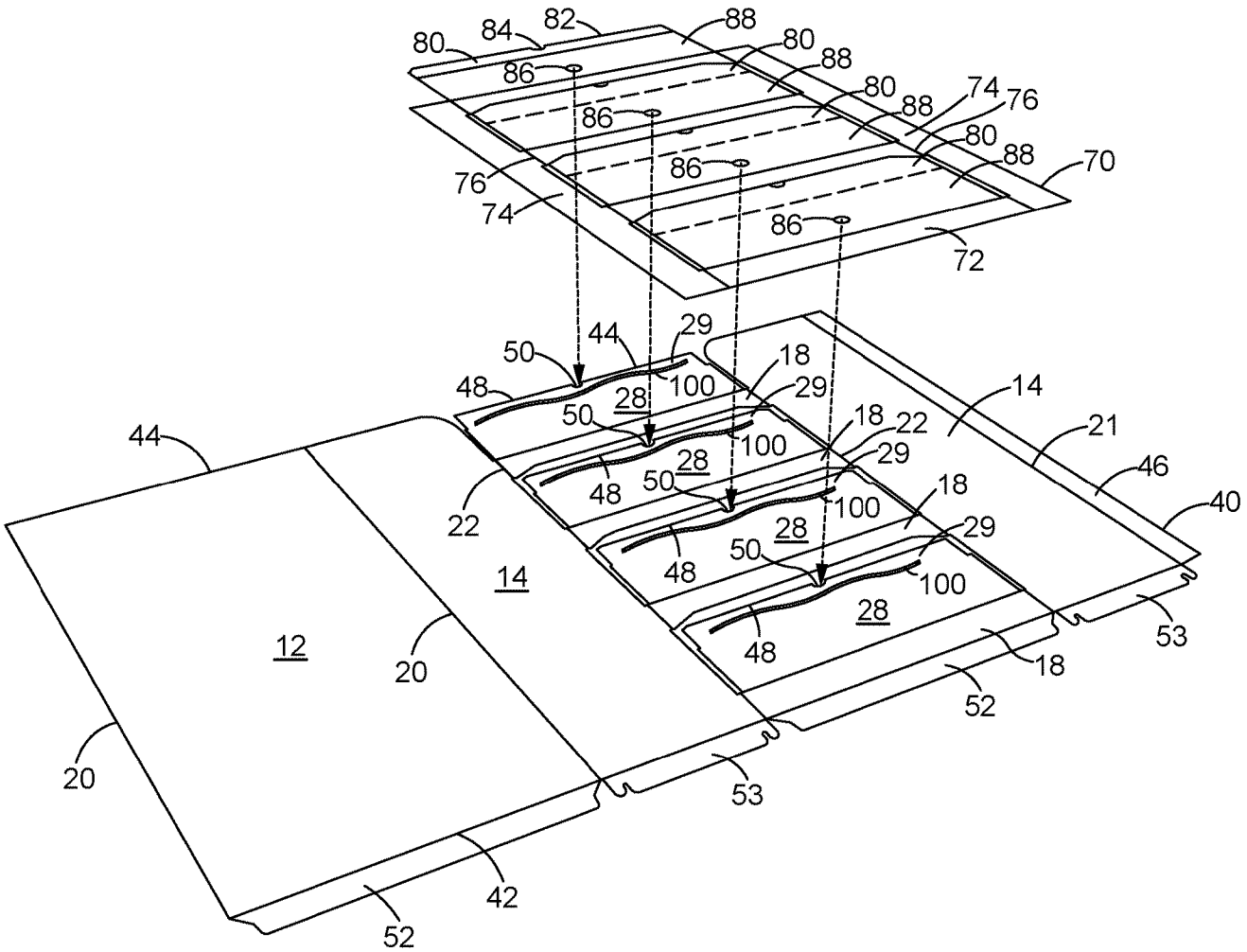
FIG. 5 is a perspective view of the second blank before being adhered to the first blank.

Step 104: Adhering the front shelf panels 28 of the first blank 40 to the rear shelf panels 88 of the second blank 70 to achieve a first intermediate structure 103. Glue or other adhesive is applied to certain of the mating surfaces of the first blank 40 and/or the second blank 70 prior to adhering them together. For example, glue 100 may be applied to the glue area 29 of each of the front shelf panels 28 near the free rear edges 48 as shown in FIG. 5. During this step the first blank 40 and the second blank 70 are brought together so that the four locating holes 86 in the center support/second blank 70 align with the four first locating notches 50 in the body blank/first blank 40. After the two blanks 40, 70 are adhered together to form the first intermediate structure 103 shown in FIG. 6, the second blank 70 extends above the first blank 40. Also, the fold lines 76 in the second blank 70 align with the front vertical edges 22 in the first blank 40.

Figure 6:
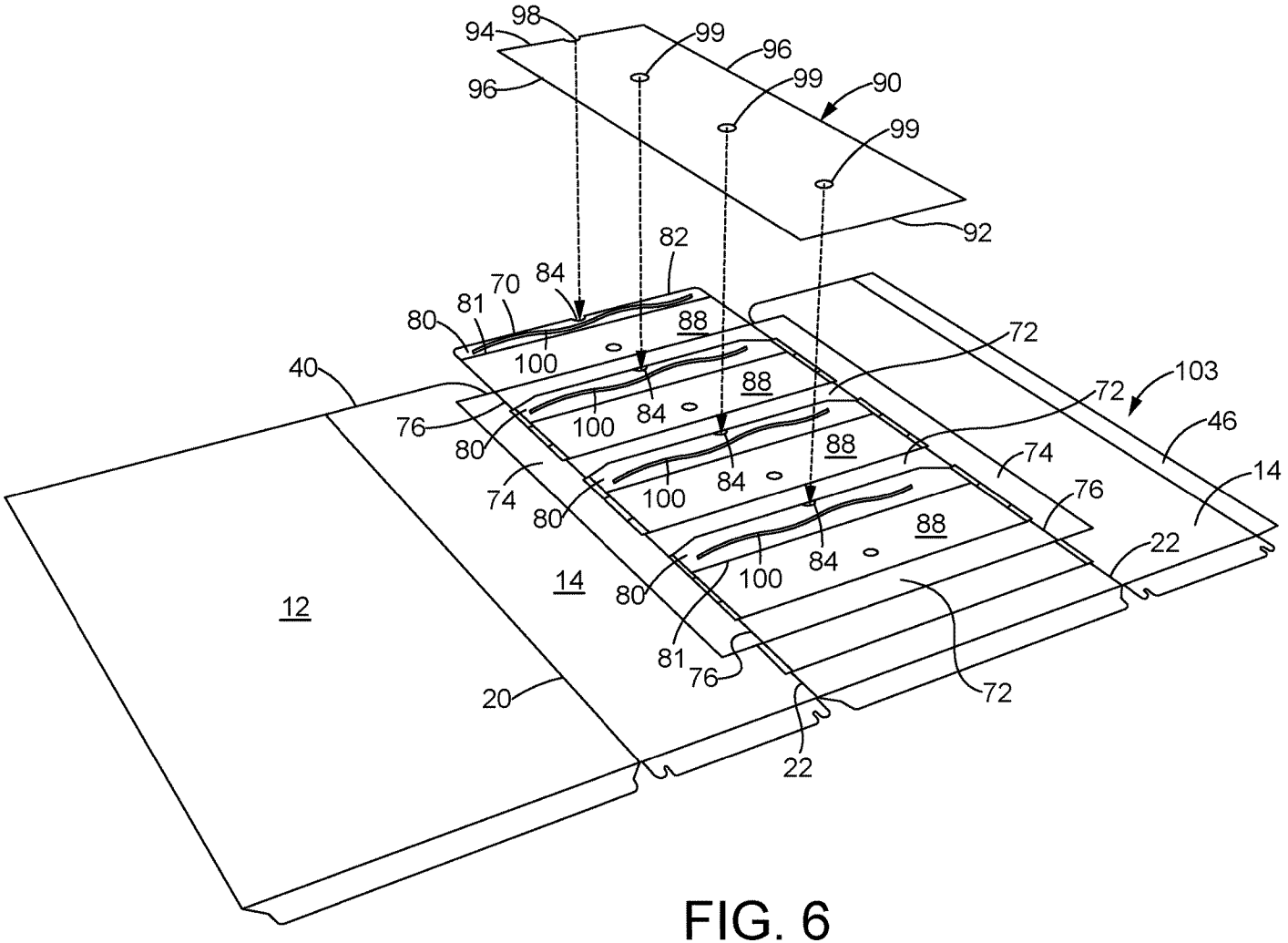
FIG. 6 is a perspective view of the third blank before being adhered to the first and second blanks to achieve a partially constructed hutch.

Step 106: Adhering the rear attachment panels 80 to the third blank 90 to achieve a second intermediate structure 105. Glue or other adhesive is applied to certain of the mating surfaces of the first intermediate structure 103 and/or the third blank 90. For example, glue 100 may be applied to the rear attachment panels 80 of the second blank 70 as shown in FIG. 6. During this step the first intermediate structure 103 and the third blank 90 are brought together so that the third locating notch 98 and the second locating holes 99 in the third blank 90 align with the second locating notches 84 in the second blank 70. After the first intermediate structure 103 and the third blank 90 are adhered together to form a second intermediate structure 105, the top edge 94 of the third blank second blank 70 should align with the top edge 82 of the second blank 70.

Figure 7:
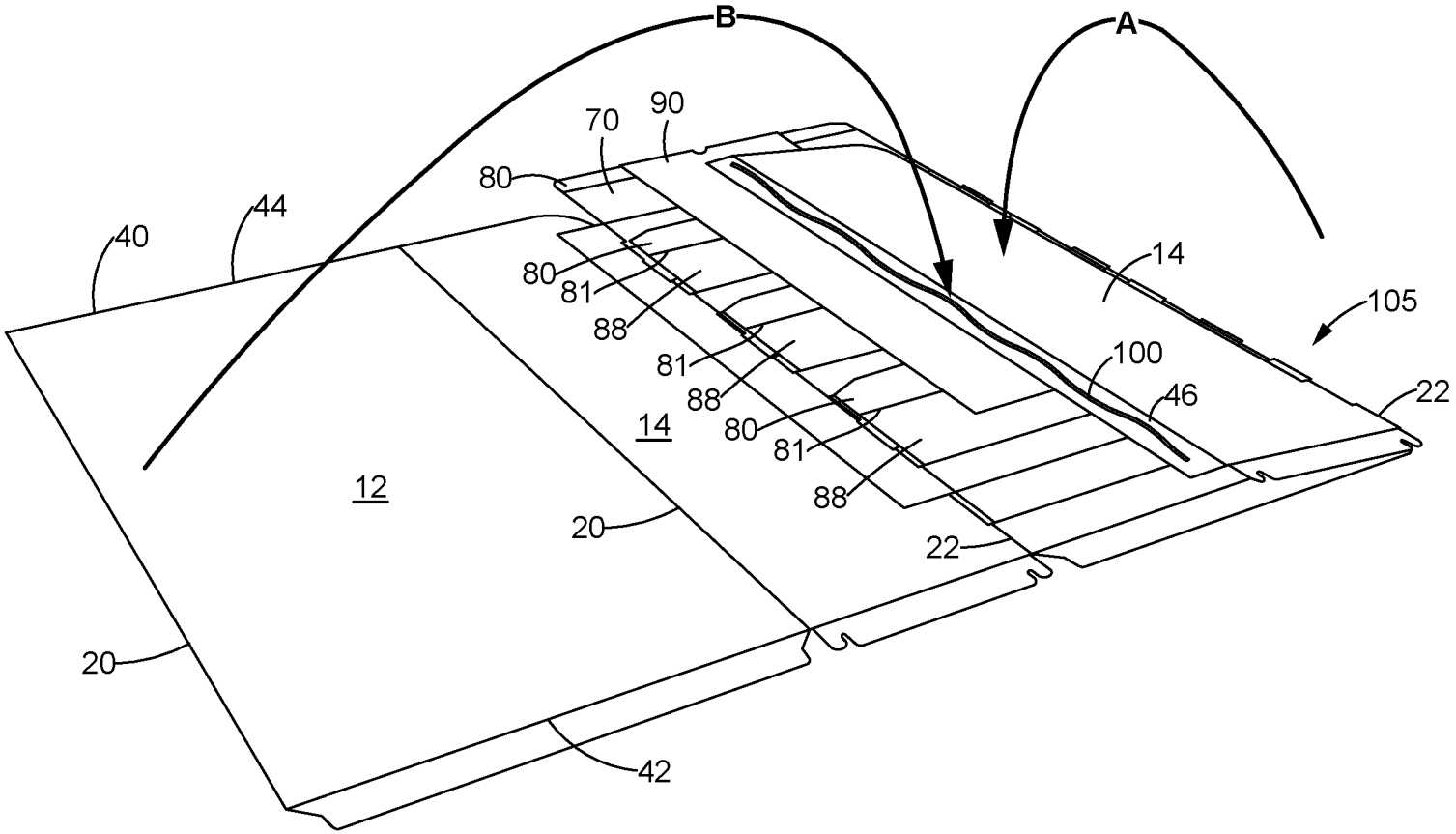
FIG. 7 is a perspective view of the partially constructed hutch of FIG. 6 after partial folding.

Step 106: Next, the second intermediate structure 105 is folded and glued to achieve a folded (pre-assembled) hutch 10. For example, as shown in FIG. 7, one side wall 14 may be folded inward along fold line 22 as indicated by arrow A until it is flat against the second blank 70.

Step 108: Folding the second side wall 14 inward along fold line 22 until it is flat against the second blank 70 and the third blank 90. Glue may be applied to the glue panel 46.

Figure 8:
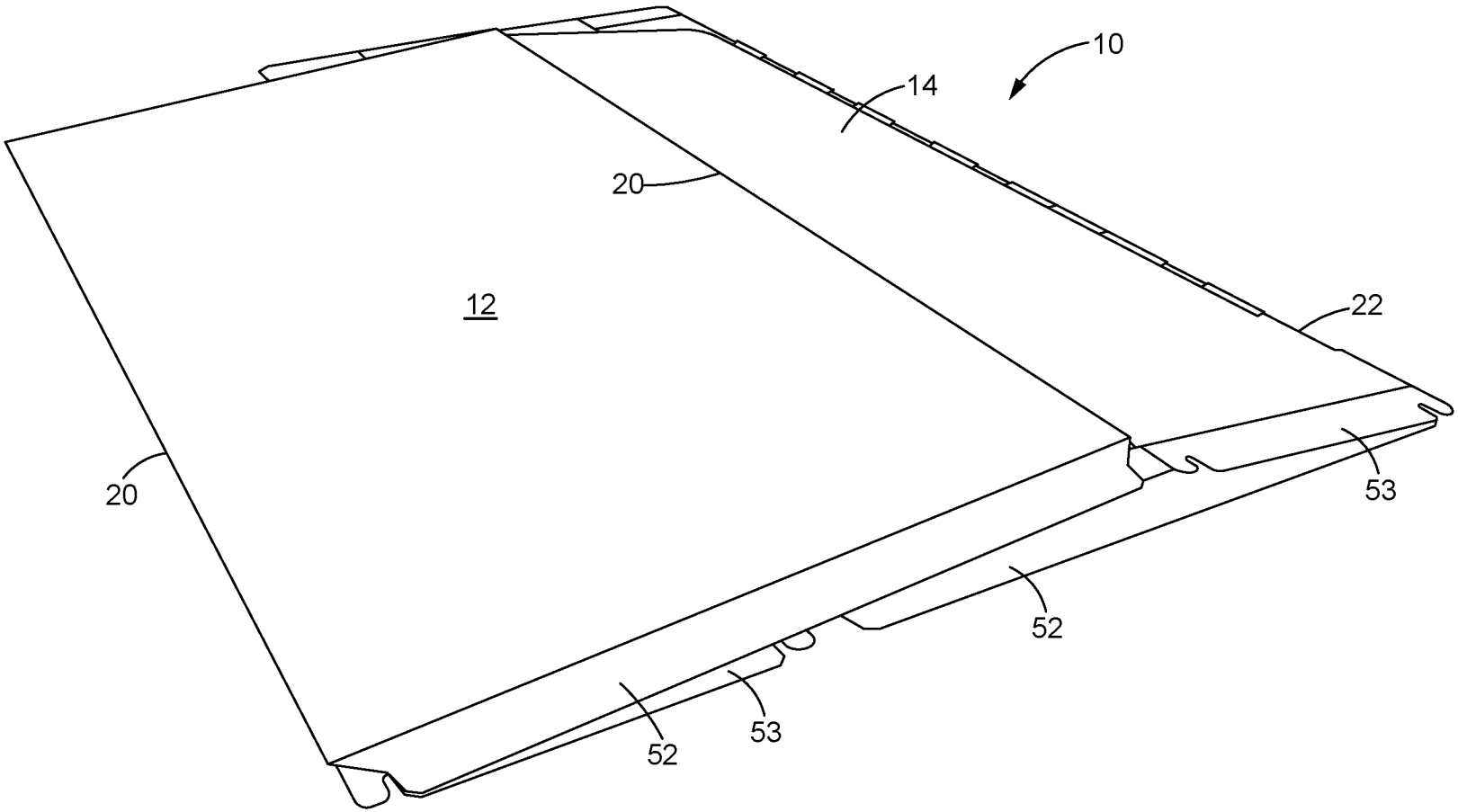
FIG. 8 is a perspective view of the partially constructed hutch of FIG. 7 after further folding to achieve a pre-assembled hutch.
Figure 9:
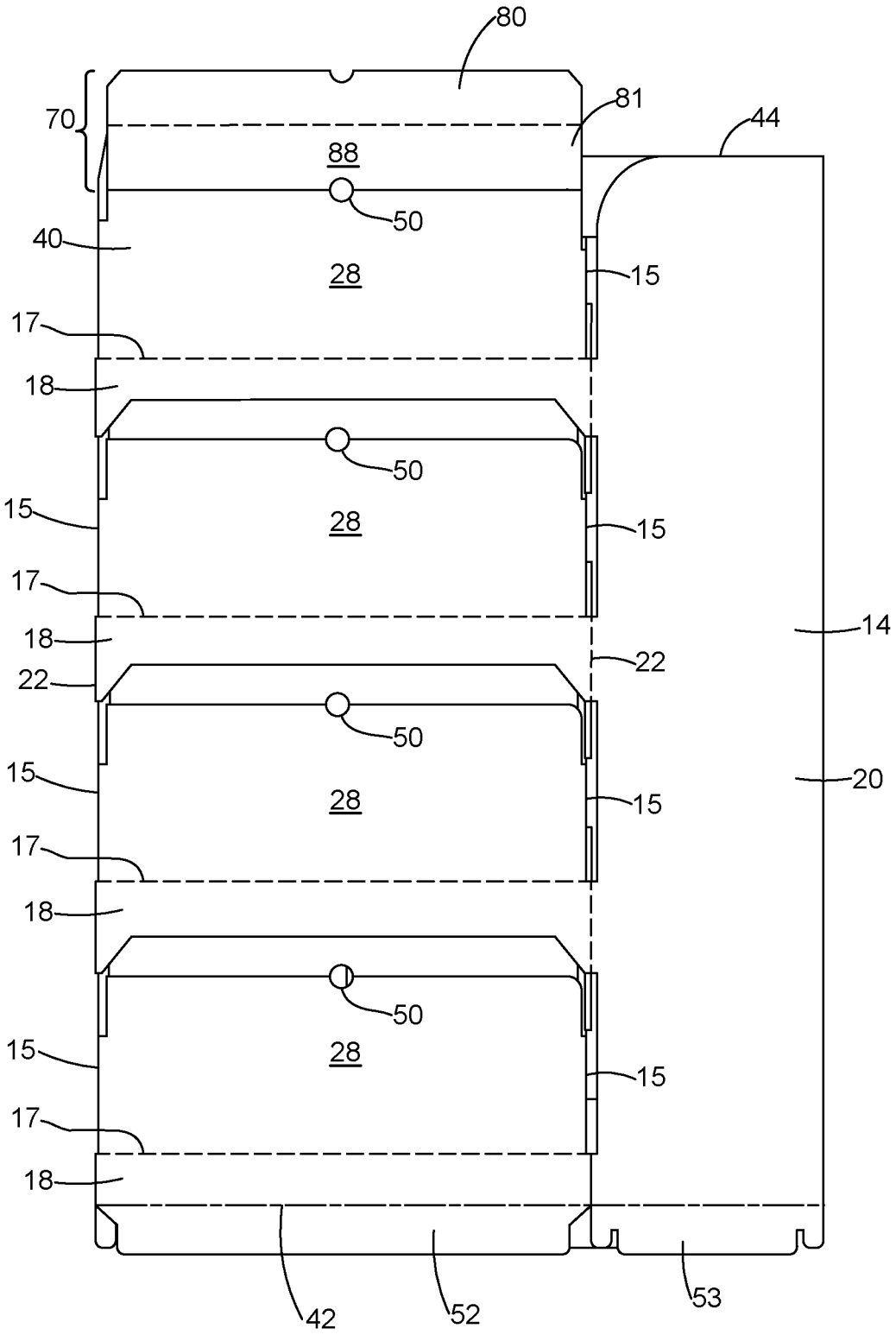
FIG. 9 is a perspective view of the pre-assembled hutch of FIG. 8 after being flipped over.

Step 110: Folding the rear wall 12 inwardly along fold line 20 until the rear wall 12 contacts and is adhered to the glue panel 46 to achieve the constructed hutch 10 in a folded condition. The rear wall 12 may be folded inwardly along fold line 20 as indicated by arrow B until the rear wall 12 contacts and is adhered to the glue panel 46. FIG. 8 is a perspective view of the folded (pre-assembled) hutch 10. FIG. 9 is a perspective view of the folded hutch 10 shown in FIG. 8 after being flipped over.

Assembling the Hutch

Figure 14:
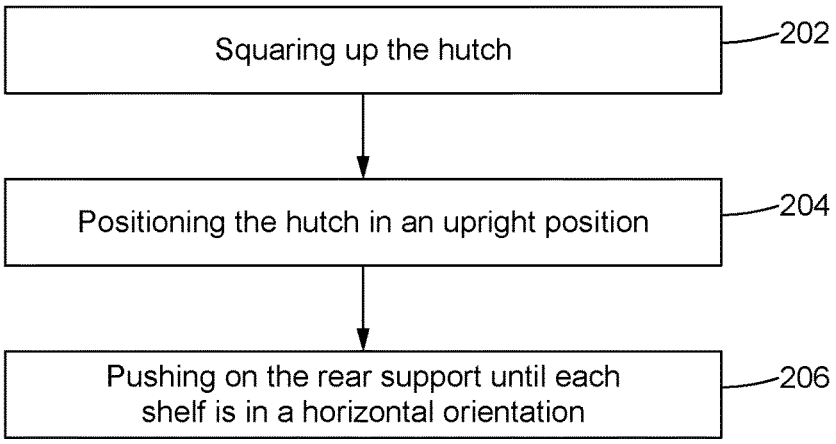
FIG. 14 is a flowchart illustrating a method of assembling the hutch of FIG. 1.

FIG. 14 is a flowchart illustrating a method of assembling the hutch of FIG. 1. Starting with the folded (pre-assembled) hutch 10 of FIG. 8, the hutch 10 of FIG. 1 may be easily assembled as will now be described with reference to FIGS. 10-12.

Figure 10:
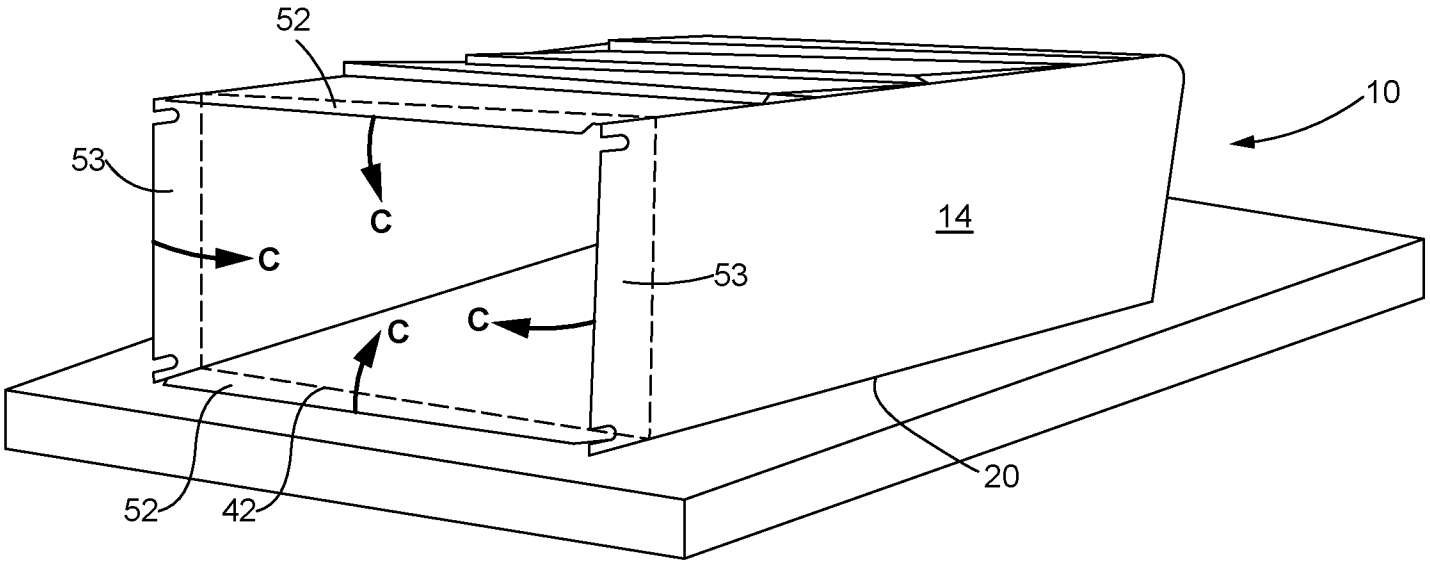
FIG. 10 is a perspective view of the pre-assembled hutch of FIGS. 8 and 9 undergoing some initial assembly.
Figure 11:
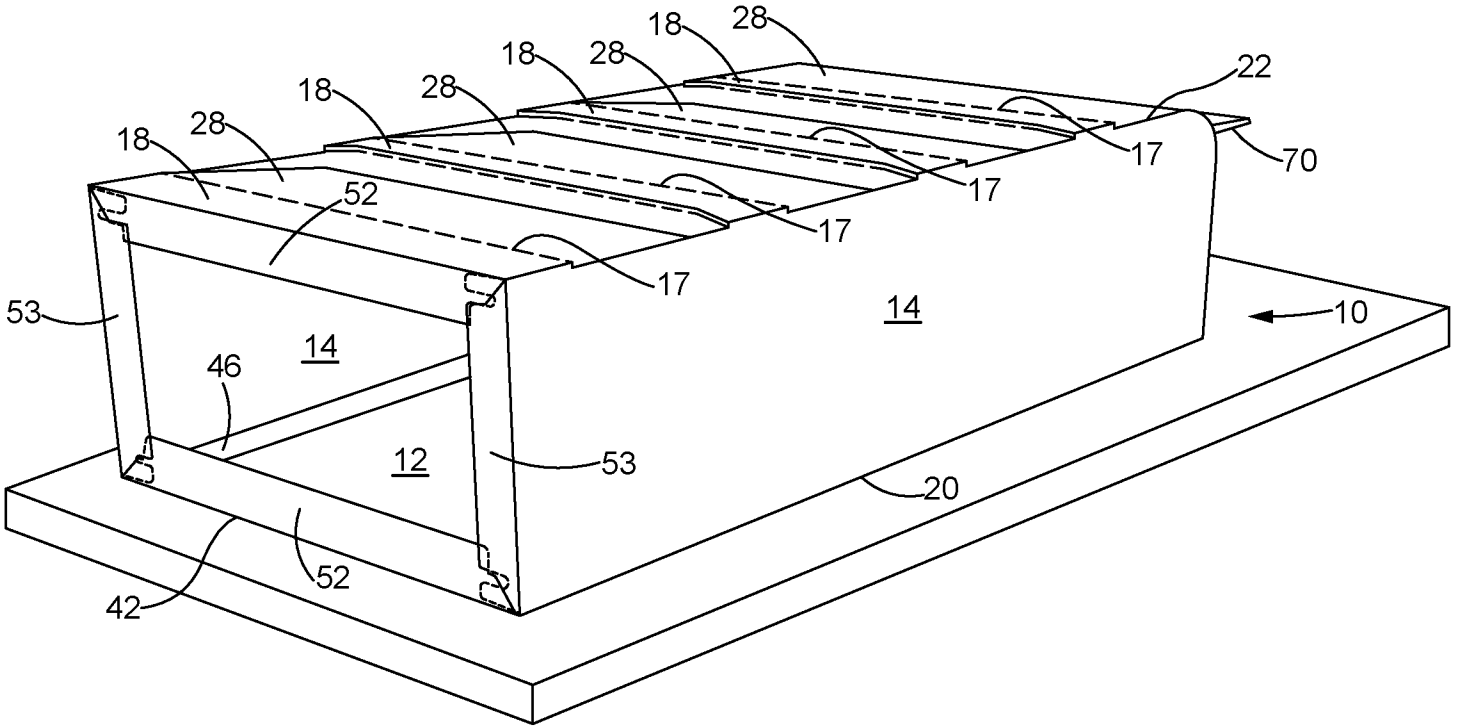
FIG. 11 is a perspective view of the hutch of FIG. 10 after further assembly.

Step 202: First, the folded hutch 10 of FIG. 8 is squared up as shown in FIG. 10 so that the side walls 14 are parallel and the corners form right angles. The bottom panels 52, 53 may be folded inwardly in the direction of arrows C and interlocked as shown in FIG. 11.

Figure 12:
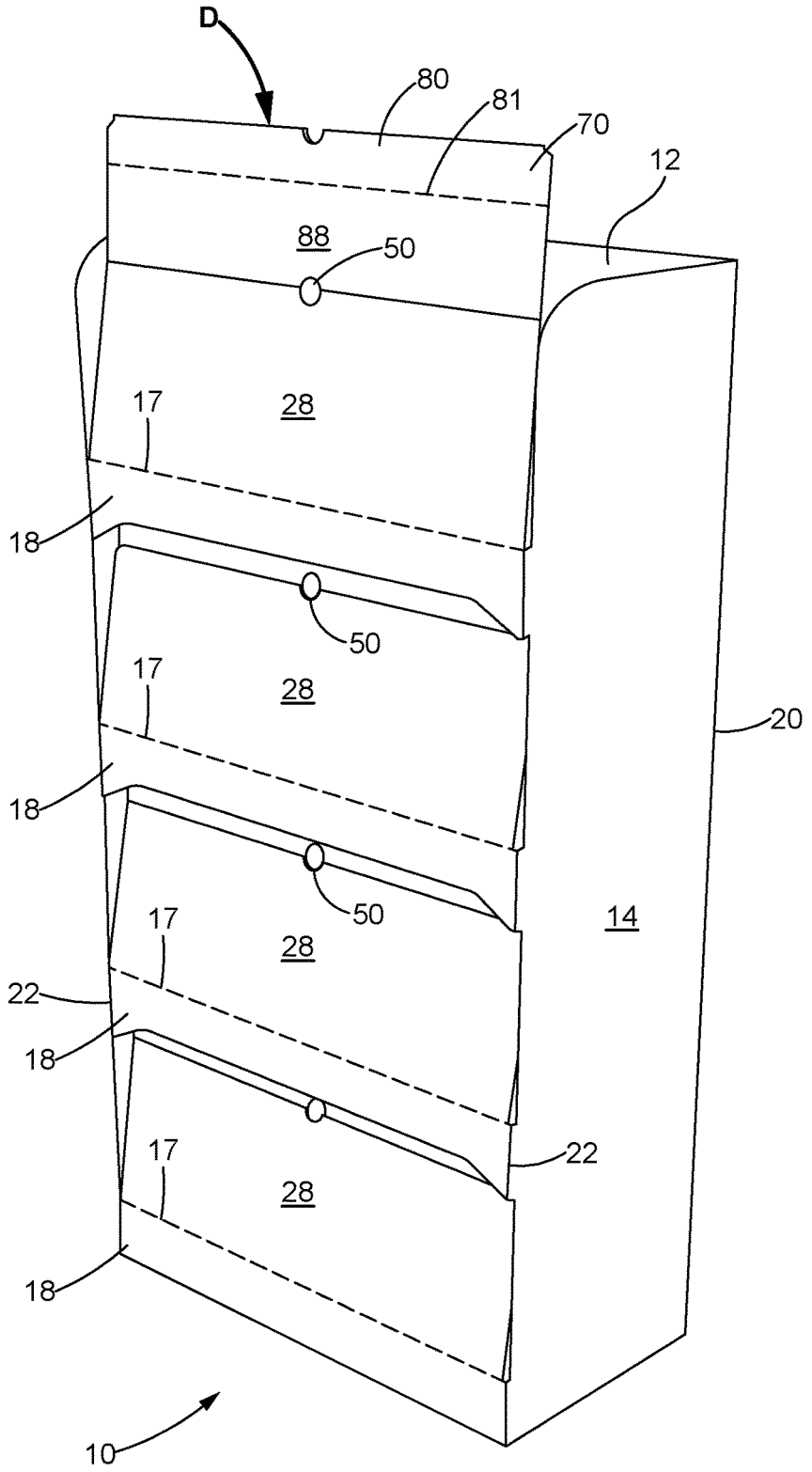
FIG. 12 is a perspective view of the hutch of FIG. 11 after it has been stood on its base.

Step 204: Next, the hutch 10 may be stood on its base (i.e., the bottom panels 52, 53) so that the hutch 10 is upright, as shown in FIG. 12.

Step 206: Finally, the rear support 90 and/or the center support 70 are pushed downward and rearward in the direction of arrow D in FIG. 12 until the shelves 16 are in a horizontal orientation. Upon pushing downward on the rear support 90, every shelf 16 is "automatically" assembled and the finished hutch 10 shown in FIG. 1 is achieved.

It should be understood that the embodiments described above are only particular examples which serve to illustrate the principles of the invention. Modifications and alternative embodiments are contemplated which do not depart from the scope of the invention as defined by the foregoing teachings and appended claims. It is intended that the claims cover all such modifications and alternative embodiments that fall within their scope.

The invention claimed is:

1. A display hutch comprising:

a rear wall extending vertically from a base to a top edge and horizontally from one rear vertical edge to another rear vertical edge;

two side walls, each side wall extending from a respective one of the rear vertical edges forward to a respective front vertical edge;

a plurality of front panels, each front panel extending laterally from and hingedly attached to each side wall along the front vertical edges;

the rear wall, the side walls and the front panels defining a hutch body having an interior;

a rear support substantially disposed within the interior; and a plurality of shelves, each shelf comprising a front shelf panel and a rear shelf panel adhered to the front shelf panel, each front shelf panel hingedly attached to a respective one of the front panels along a shelf front fold line, each shelf extending laterally between one of the two side walls and another one of the two side walls but not directly connected to either side wall, each rear shelf panel foldably connected to a rear attachment panel along a rear fold line, each rear attachment panel attached to the rear support; wherein moving the rear support causes the shelves to move in unison between a first position in which each shelf is in a vertical orientation and a second position in which each shelf is in a horizontal orientation suitable for bearing a load, wherein:

the rear wall, the side walls, the front panels and the front shelf panels are formed from a first blank;

the rear shelf panels and the rear attachment panels are formed from a second blank; and the rear support is formed from a third blank.

2. The hutch of claim 1 wherein:

the second blank further comprises middle panels extending laterally between and attached to a pair of middle vertical panels; and each rear shelf panel is hingedly attached to a respective one of the middle panels along a middle fold line extending laterally between the pair of middle vertical panels.

3. The hutch of claim 1 wherein:

the rear support is adjacent the rear wall when the shelves are in the second position.

4. A method of constructing a hutch comprising the steps of:

providing a first blank, a second blank and a third blank; the first blank comprising a rear wall, first and second side walls, front panels, front shelf panels and a glue panel, the rear wall extending from a bottom edge to a top edge and horizontally from a first rear vertical edge to an opposite second rear vertical edge, the rear wall foldably connected to the first side wall along the first rear vertical edge, the first side wall foldably connected to the front panels along a first front vertical edge, the second side wall foldably connected to the front panels along a second front vertical edge and to the glue panel along a glue panel fold line, each front shelf panel foldably connected to a respective one of the front panels along a shelf front edge, each front shelf panel having a free rear edge;

the second blank comprising rear shelf panels, rear attachment panels, middle panels and two middle vertical panels, the middle panels extending laterally between and attached to the two middle vertical panels, each rear shelf panel hingedly attached to a respective one of the middle panels along a middle fold line extending laterally between the two middle vertical panels and to a rear attachment panel along a rear fold line; and the third blank extends from a bottom edge to a top edge and from one side edge to an opposite side edge;

adhering each of the front shelf panels to a respective one of the rear shelf panels;

adhering the attachment panels to the third blank;

folding the second side wall inward along the second front vertical edge; and folding the rear wall inwardly along the first rear vertical edge and adhering the rear wall to the glue panel.

5. The method of claim 4 wherein:

each rear free edge defines a first locating notch;

each rear attachment panel has a free top edge that defines a second locating notch;

each rear shelf panel defines a locating hole;

the third blank top edge defines a third locating notch and the third blank defines second locating holes spaced apart in the vertical dimension; and during the step of adhering the front shelf panels to the rear shelf panels, the first blank and the second blank are aligned so that the locating holes align with the first locating notches.

6. The method of claim 5 wherein:

during the step of adhering the attachment panels to the third blank, the rear attachment panels and the third blank are aligned so that the third locating notch and each of the second locating holes in the third blank align with a respective one of the second locating notches.

7. A method of assembling a hutch comprising the steps of:

squaring up the hutch of claim 4 so that the side walls are parallel with each other and the front panels are parallel with the rear wall;

positioning the hutch so that the hutch is upright; and pushing on the rear support until each shelf is in a horizontal orientation.

8. The method of claim 7 wherein:

the first blank further comprises bottom panels configured to interlock with each other; and the method comprises the additional step of interlocking the bottom panels.

9. A display hutch comprising:

a rear wall extending vertically from a base to a top edge and horizontally from a first rear vertical edge to a second rear vertical edge;

two side walls, each side wall extending from a respective one of the rear vertical edges forward to a respective front vertical edge;

a plurality of front panels, each front panel extending laterally from and hingedly attached to each side wall along the front vertical edges;

the rear wall, the side walls and the front panels defining a hutch body having an interior;

a rear support substantially disposed within the interior; and a plurality of shelves, each shelf comprising a front shelf panel and a rear shelf panel adhered to the front shelf panel, each front shelf panel hingedly attached to a respective one of the front panels along a shelf front fold line, each rear shelf panel foldably connected to a rear attachment panel along a rear fold line, each rear attachment panel attached to the rear support, wherein:

the rear wall, the side walls, the front panels and the front shelf panels are formed from a first blank;

the rear shelf panels and the rear attachment panels are formed from a second blank; and the rear support is formed from a third blank.

10. The hutch of claim 9 wherein:

moving the rear support causes the shelves to rotate in unison, each about a respective shelf front fold line, between a first position in which each shelf is in a vertical orientation and a second position in which each shelf is in a horizontal orientation.

11. The hutch of claim 9 wherein:

the second blank further comprises middle panels extending laterally between and attached to a pair of middle vertical panels; and each rear shelf panel is hingedly attached to a respective one of the middle panels along a middle fold line extending laterally between the middle vertical panels.

12. The hutch of claim 11 wherein:

the rear support is adjacent the rear wall when the shelves are in the second position.

* * * * *